United States Patent [19]

Nelson

[11] Patent Number: 5,063,084

[45] Date of Patent: Nov. 5, 1991

[54] METHOD OF PREVENTING ADHERENCE OF INSECT RESIDUES TO VEHICULAR SURFACES

[76] Inventor: Riley H. Nelson, 131 E. Hwy. 50, Winter Garden, Fla. 32787

[21] Appl. No.: 531,054

[22] Filed: May 31, 1990

[51] Int. Cl.[5] ..... B05D 5/08

[52] U.S. Cl. ..... 427/154; 427/155; 427/156; 106/2

[58] Field of Search ..... 427/154, 155, 156; 252/89.1, 174.21, 174.22, DIG. 14; 106/2

[56] References Cited

U.S. PATENT DOCUMENTS 4,620,937 11/1986 Dellutri ..... 252/DIG. 14
4,632,848 12/1986 Gosset et al. ..... 427/154
4,895,675 1/1990 Smith ..... 252/DIG. 14

FOREIGN PATENT DOCUMENTS 2170816 8/1986 United Kingdom ..... 252/DIG. 14

*Primary Examiner*—Shrive Beck
*Assistant Examiner*—Terry J. Owens
*Attorney, Agent, or Firm*—William M. Hobby, III

[57] ABSTRACT

A process for protecting vehicle windshields and chrome-plated, painted and other vehicular surfaces with a coating which prevents adherence of insects impacting with such surfaces and any chemical reaction of bug remains therewith. The coating is water soluble and contains an oil barrier, surfactant, hydrophilic agent and lipophilic agent, among other ingredients. The impacted insect remains are easily removable by washing off the coating with water.

8 Claims, No Drawings

METHOD OF PREVENTING ADHERENCE OF INSECT RESIDUES TO VEHICULAR SURFACES

BACKGROUND OF THE INVENTION

The present invention relates to a protective coating for application to a vehicle, and particularly to the windshield and front end of a vehicle, to prevent adherence of insects impacting with the vehicle and the consequent corrosive damage to the vehicle's painted surface.

In the past, a number of remedies have been utilized to deal with the problem of large numbers of bugs splattered against the windshields and front ends of vehicles. At certain times of the year the problem is exacerbated by clouds of "love bugs" which feed on dead grasses and other vegetation along the highways during the daytime. A vehicle used for a long trip can be literally covered with splattered bug remains after only a few hours on the highway. These residues are extremely difficult and time-consuming to remove, particularly from the painted surfaces of a vehicle, even using specially designed bug removal products, and nearly always result in a modicum of damage to automobile paint, because of the corrosive properties of these residues. One preventive remedy has been to attach a clear plastic deflector on the front of the hood to deflect air currents flowing over the hood away from the windshield. Nylon or other fabric mesh has been used to make protective screens which are removably attached over the front end of a vehicle to catch bugs thereon and prevent them from reaching the vehicle surface. Still another remedy has been to apply vegetable oil over the front surfaces of the vehicle so that bugs impacting with the surface will not stick to the paint and can be easily removed without damage to the paint. However vegetable oil is not suitable for application to a windshield because it clouds and distorts the view therethrough. Consequently there is a need for a transparent protective coating to apply to both the painted surfaces and the windshield of a vehicle which will prevent adherence of corrosive bug remains to these surfaces, which can be readily washed off without damage to the vehicle paint, and which does not impair the driver's view through the windshield.

SUMMARY OF THE INVENTION

The present invention relates to a process for protecting vehicle windshields, chrome-plated and painted surfaces with a coating which prevents adherence of bug remains thereto and any chemical reaction of bug remains therewith, method of preparing such coating, and a method of applying the coating to a vehicle.

DETAILED DESCRIPTION OF THE PREFERRED EMBODIMENTS

The present invention utilizes a water-soluble solution comprising a "wetting agent" which lowers the surface tension of the water so that the solution will enter microscopic "pores" in the surfaces to be coated; a "spreading" agent which effectively spreads the mixture evenly, forming a film or barrier; a hydrophilic agent which facilitates removal of the coating using only water; an oil-soluble agent which permits miscibility of the oil component with the water-soluble components; non-stick oil component which prevents adherence of bug remains and adds sheen to the vehicle surfaces; a propellant/dispersant agent which aids in even spreading of the mixture and which tends to disperse the bug remains when the vehicle is washed with water. More specifically the invention utilizes the following combination of ingredients:

(a) 100 gallons of purified or soft water;
(b) from 1 to 30 gallons of a hydrophilic agent;
(c) from 1 to 18.56 gallons of an emulsifier;
(d) from 0.25 to 1.625 gallons of vegetable oil;
(e) from 1 to 22.5 gallons of chlorine-and-phosphorus-free surfactant;
(f) from 0.1 to 5.0 gallons of nonionic surfactant/detergent;
(g) from 0.0005 to 0.0015 pounds of non-toxic non-corrosive stabilizer;
(h) from 0.005 to 0.015 pounds of anti-oxidant color stabilizer, from 0.0005 to 0.015 pounds per 100 gallons of water.

This combination of ingredients has the following properties: reduced surface tension, water solubility, cleansing or detergent action, and shine-producing ability.

The preferred choices of ingredients are as follows:

(a) hydrophilic agent: aloe vera gel;
(b) emulsifier:ethylene glycol; propylene glycol was found to be undesirable because of possible reactivity;
(c) mono-unsaturated vegetable oilcastor oil or canola oil; castor oil is most effective, but very expensive, and the canola oil is nearly as effective and less expensive;
(d) chlorine, phosphorus free surfactant: dishwashing liquid, preferably "Palmolive" ® because of its color;
(e) non-ionic surfactant/detergent:
(i) "Synperonic NP 15" R and "Synperonic OP 16.5 ® (alkyl phenol ethoxylates);
(f) non-toxic, non-corrosive stabilizer: mixture of hydroquinone and monomethyl ether in widespread use as a food additive;
(g) anti-oxidant color stabilizer: mixture of one part citric acid and ninety-nine parts tertiary butyl 4-methoxyphenol (butylated anisol), known as "PM 1788".

Optimum proportions of the essential ingredients of this invention are set forth in the ensuing example.

EXAMPLE (a) purified or soft water, 100 gallons;
(b) 99–100% aloe vera gel, 4 gallons;
(c) ethylene glycol, 2 gallons;
(d) canola oil or castor oil, one quart;
(e) "Palmolive" dishwashing liquid, 2.5 gallons;
(f) alkyl phenol ethoxylates:
  (i) "Synperonic NP 15, one pint;
  (ii) "Synperonic OP 16.5, one pint;
(g) hydroquinone/monomethyl ether mixture, 0.00114 pounds;
(h) "PM 1788" (mixture of 99 parts tertiary butyl, 4-methylhydroxyphenol with 1 part citric acid), 0.00945 pounds.

"Palmolive" is a Federally-trademarked liquid detergent designed for the manual washing of dishes, pots and pans, etc. "Synperonic NP 15" and "Synperonic OP 16.5" are Federally registered trademarks for mixtures of tertiary butyl 4 methoxyphenol (also known as butylated hydroxy anisol) with citric acid, marketed by I.C.I. and Eastman Chemical, a division of Eastman Kodak Co. "PM 1788" is also a federally registered trademark.

I claim:

1. A process for preventing insect remains from adhering to and damaging surfaces of a vehicle after impacting therewith, and for making such insect remains easily removable, comprising the steps of:

A. mixing together the following ingredients:

(1) one hundred gallons of water;

(2) from one to thirty gallons of a hydrophilic agent;

(3) from one to nineteen gallons of an emulsifier;

(4) from one pint to two quarts of vegetable oil;

(5) from one to twenty-three gallons of chlorine and phosphorus-free surfactant/detergent;

(6) from one pint to five gallons of non-ionic surfactant/detergent;

(7) from 0.0005 lbs. to 0.0015 lbs. of non-toxic, non-corrosive stabilizer;

(8) from 0.005 to 0.015 lbs. of anti-oxidant/color stabilizer;

B. applying a coating of said mixture of ingredients to selected surfaces of a vehicle for which protection is desired;

C. removing insect remains from the surfaces of the vehicle by removing the coating with water.

2. The process according to claim 1 wherein the hydrophilic agent is aloe vera gel.

3. The process according to claim 1 wherein the emulsifier is ethylene glycol.

4. The process according to claim 1 wherein the vegetable oil is a mono-unsaturate oil.

5. The process according to claim 1 wherein the chlorine-and-phosphorus-free detergent is dishwashing liquid detergent.

6. The process according to claim 1 wherein the non-ionic surfactant/detergent is an alkyl phenol ethoxylate.

7. The process according to claim 1 wherein the non-toxic, non-corrosive stabilizer is a mixture of citric acid and tertiary butyl 4-methoxyphenol.

8. The process according to claim 1 wherein the anti-oxidant/color stabilizer is a food additive consisting of a mixture of hydroquinone and monomethyl ether.

* * * * *